US007413528B2

(12) United States Patent
Nestler

(10) Patent No.: US 7,413,528 B2
(45) Date of Patent: Aug. 19, 2008

(54) EXERCISE DEVICE FOR IMPROVING PHYSICAL FITNESS

(75) Inventor: Reimar Nestler, Chemnitz (DE)

(73) Assignee: Sport-Thieme GmbH, Grasleben (DE)

( * ) Notice: Subject to any disclaimer, the term of this patent is extended or adjusted under 35 U.S.C. 154(b) by 272 days.

(21) Appl. No.: 10/811,047

(22) Filed: Mar. 26, 2004

(65) Prior Publication Data

US 2004/0192510 A1 Sep. 30, 2004

(30) Foreign Application Priority Data

Mar. 26, 2003 (DE) ..... 103 13 524

(51) Int. Cl.
*A63B 21/22* (2006.01)
*A63B 21/00* (2006.01)

(52) U.S. Cl. ..... 482/52; 482/51

(58) Field of Classification Search ..... 482/51, 482/52, 57, 70, 79–80
See application file for complete search history.

(56) References Cited

U.S. PATENT DOCUMENTS 2,081,365 A * 5/1937 Mueller et al. ..... 601/30
3,667,453 A * 6/1972 Schenck et al. ..... 601/5
4,570,927 A * 2/1986 Petrofsky et al. ..... 482/60
6,027,432 A * 2/2000 Cheng ..... 482/57
6,077,201 A * 6/2000 Cheng ..... 482/57
6,217,491 B1 * 4/2001 Schiessl ..... 482/92
6,659,918 B2 * 12/2003 Schiessl ..... 482/92
6,793,609 B1 * 9/2004 Fan ..... 482/57
7,137,929 B2 * 11/2006 Fan ..... 482/57

FOREIGN PATENT DOCUMENTS

DE 200 10 140 11/2000
DE 201 15 605 4/2002
GB 2 106 398 4/1983

* cited by examiner

*Primary Examiner*—Steve R Crow
(74) *Attorney, Agent, or Firm*—Collard & Roe, P.C.

(57) ABSTRACT

An exercise device for improving physical fitness, includes a base body having several modules for supporting an exercising person. At least one of these modules can be displaced by the exercising person, by means of his/her feet, hands, or other body parts. The exercise device is equipped, in addition to its device-specific function, with an additional vibration function in which the vibration can be regulated in terms of frequency and amplitude, and is effective only on those components on which the exercising person is supporting himself/herself. Each module for supporting the exercising person has a separate component that is effectively connected with the body part of the exercising person assigned to it. This component is connected with the other components of this module by way of at least one damping element, and can have a vibration movement applied to it.

6 Claims, 1 Drawing Sheet

EXERCISE DEVICE FOR IMPROVING PHYSICAL FITNESS

CROSS REFERENCE TO RELATED APPLICATIONS

Applicant claims priority under 35 U.S.C. §119 of German Application No. 103 13 524.3 filed Mar. 26, 2003.

BACKGROUND OF THE INVENTION

1. Field of the Invention

The present invention relates to an exercise device for improving physical fitness, including a base body having several modules for supporting an exercising person. At least one of these modules can be displaced by the exercising person, by means of his/her feet, hands or other body parts. The exercise device is equipped, in addition to its device-specific function, with an additional vibration function.

2. The Prior Art

From medicine, numerous applications are known in which the human organism is stimulated by means of mechanical vibrations. Since various types of studies have shown that targeted vibration of the human body can bring about positive effects with regard to mobility and level of strength, such stimulation is increasingly targeted for sports applications, as well.

Thus, the vibration exercise device according to DE 201 15 605 U1 has a foot platform, an abdominal support, and a handlebar, each of which vibrates. Accordingly, several body parts can have vibration applied to them at the same time. However, it is a disadvantage that the exercising person must remain in a static body position, so that his/her body rests against the vibrating components, which are in a fixed position.

The muscle exerciser according to DE 200 10 140 U1 has several handles or surfaces on which the body of the exercising person is supported and that have a vibration movement applied to them. At least one of these vibrating modules can be displaced, so that the exercising person can perform pressing movements with his/her feet, for example. These additional movements by the exercising person improve the exercise effect.

DE 32 29 152 C 2 describes a bicycle-like exercise device for improving physical fitness. Here, a polygon-shaped plate is moved by activating the pedals, which plate causes a shaking movement of the components in which the exercising person is supporting himself/herself with the hands, abdomen and back, by way of several connecting elements. A positive exercise effect is achieved by means of the combination of bicycling exercise and vibration. Consequently, equipping conventional exercise devices with an additional vibration function can be fundamentally assessed as being positive. However, the vibration parameters are dependent on the intensity by which the pedals of the pedal crank are being activated by the exercising person. Targeted adaptation to individual body parts or user-dependent exercise goals is not possible. Furthermore, the vibration cannot be limited to the components on which the exercising person is supporting himself/herself. Instead, the entire exercise device starts vibrating if the pedals are activated intensively. This vibration impairs the stability of the device and causes great mechanical stress on all of the components.

SUMMARY OF THE INVENTION

It is an object of the present invention to provide an exercise device for improving physical fitness that, in addition to its device-specific function, is equipped with an additional vibration function, whereby the vibration can be regulated in terms of frequency and amplitude, and is designed to be effective only on those components on which the exercising person is supporting himself/herself.

These objects are accomplished, according to the invention, by providing an exercise device in which each module for supporting the exercising person has a separate component that is in an effect connection with the body part of the exercising person assigned to it. This component is connected with the other components of this module by way of at least one damping element, and can have a vibration movement applied to it. Preferably, the separate components can optionally have a vibration movement applied to them, independent of one another. Other advantageous embodiments are discussed below, whose characteristics and effects will be explained in greater detail in the exemplary embodiment.

In accordance with the invention, it becomes possible to equip conventional exercise devices with an additional vibration function, so that the vibration becomes effective only at those modules on which the exercising person is supporting himself/herself with the hands, feet and other body parts. Consequently, great stability and low stress on the components of the exercise device are guaranteed. Another advantage is the vibration of selected components, which now becomes possible as an option. Thus, individual adaptation to user-dependent parameters can be implemented, for example with regard to a concrete exercise goal or health state. In the end result, greater muscle development can be achieved with shorter exercise, whereby blood circulation and therefore metabolism are being promoted at the same time, in addition to mobility.

BRIEF DESCRIPTION OF THE DRAWINGS

Other objects and features of the present invention will become apparent from the following detailed description considered in connection with the accompanying drawing. It should be understood, however, that the drawing is designed for the purpose of illustration only and not as a definition of the limits of the invention.

In the drawing.

DETAILED DESCRIPTION OF PREFERRED EMBODIMENTS

Figure 1:
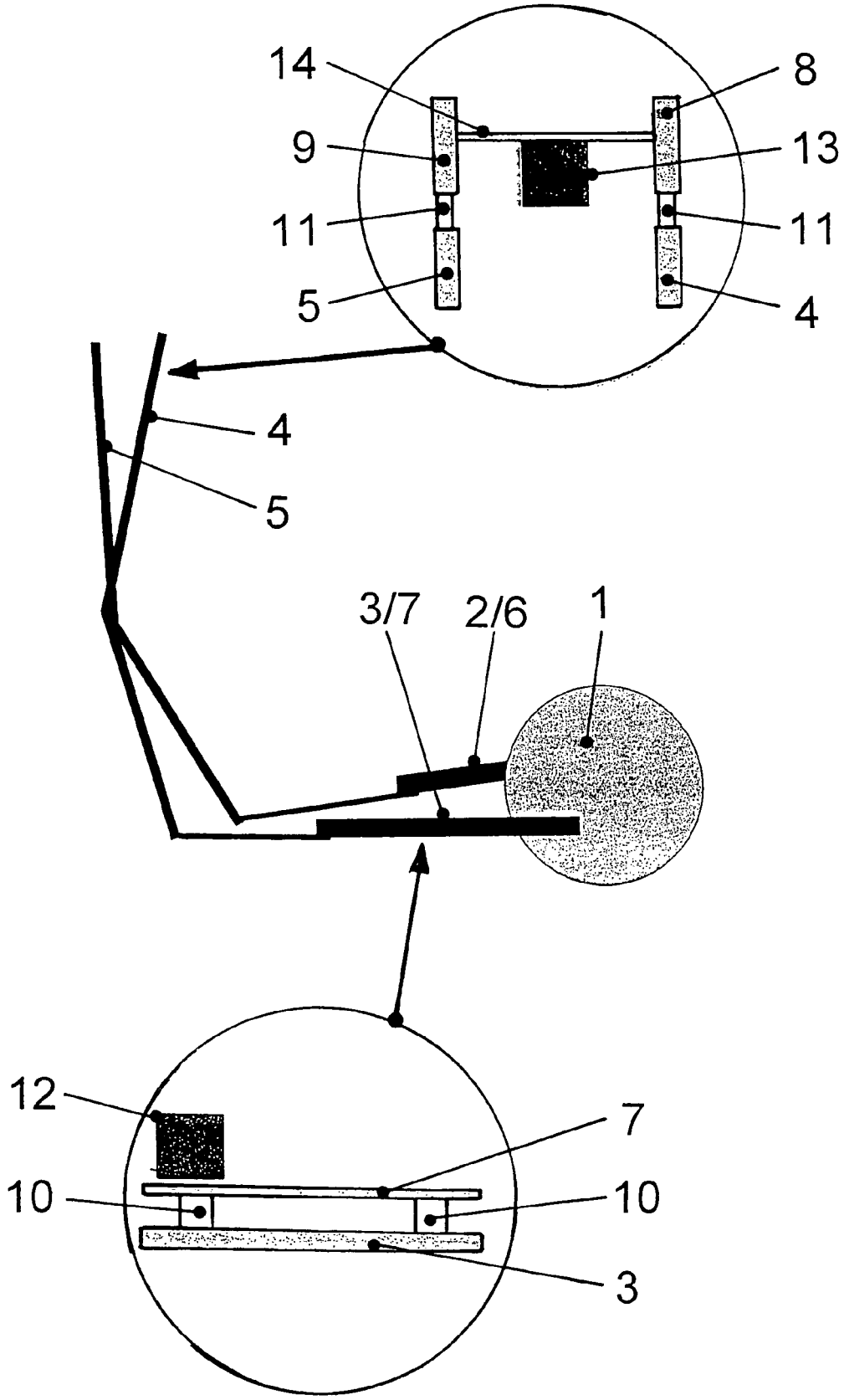
FIG. 1, the sole FIGURE, schematically shows an embodiment of the invention in which the exercise device is structured as a cross-trainer, with enlarged detailed representations of the modules.

The exercise device is made up, in known manner, of a base body having several modules for supporting an exercising person. The vibration movement can be produced electrically or pneumatically. The exercise device can be equipped in different ways, for example as a bicycle-like device or as a rowing device. In the preferred embodiment, shown in FIG. 1, the exercise device is structured as a cross-trainer.

The cross-trainer shown in FIG. 1 includes a base body having several modules. This structure is known and is largely unimportant in the present case. For this reason, only those modules that are essential for the configuration according to the invention are shown in the drawing, in addition to the flywheel 1. These modules can also be seen in two additional detailed representations, also in an enlarged view.

The cross-trainer has two step surfaces 2 and 3 as well as two handlebars 4 and 5. One step surface is connected with one handlebar, in each instance; in the exemplary embodiment, step surface 2 is connected with handlebar 5, and step surface 3 is connected with handlebar 4. Each step surface 2 and 3 as well as each handlebar 4 and 5 has an additional component assigned to it, on which the exercising person supports himself/herself. A separate footplate 6 and 7 is assigned to step surfaces 2 and 3, respectively, as an additional component. A separate handle segment 8 and 9 is assigned to handlebars 4 and 5, respectively, as an additional component. Footplates 6 and 7 as well as handle segments 8 and 9 can have a vibration movement applied to them. This vibration movement can be switched off as a function of the requirements, in each instance, and it can also be limited merely to footplates 6 and 7 or to handle segments 8 and 9 or to a single one of these components. Furthermore, the vibration movement can be regulated in terms of its frequency and amplitude.

At least one damping element 10 is arranged between each step surface 2 and 3 and the footplate 6 and 7 assigned to them, in each instance. In the exemplary embodiment shown, two such damping elements 10 are provided. Furthermore, a damping element 11 is arranged between each handlebar 4 and 5 as well as the handle segment 8 and 9 assigned to them, in each instance. The intermediate use of damping elements 10 and 11 guarantees that the vibration is limited to those components on which the exercising person is supporting himself/herself. Otherwise the entire exercise device would vibrate, which would impair the stability of the cross-trainer, on the one hand, and unnecessarily increase the mechanical stress on the other modules, on the other hand.

As already explained above, the vibration movement can be produced in different ways. For the vibration movement of footplates 6 and 7 as well as handle segments 8 and 9, an electric drive is preferred, because the cross-trainer (e.g. if it is equipped with an electromagnetic eddy current brake) predominantly has an electrical connection. For example, a vibration motor 12 can be assigned to each footplate 6 and 7. At the same time, an additional vibration motor 13 can be assigned to handle segments 8 and 9. Advantages result if the handle segments 8 and 9 are connected with one another by way of a connection element 14 to which vibration motor 13 is assigned. As an alternative to an electric drive, the vibration movement of footplates 6 and 7 as well as handle segments 8 and 9 can also be produced pneumatically, whereby then an additional compressor would be required.

While only at least one embodiment of the present invention has been shown and described, it is to be understood that many changes and modifications may be made thereunto without departing from the spirit and scope of the invention as defined in the appended claims.

What is claimed is:

1. An exercise device for improving physical fitness, comprising:

(a) a base body having a plurality of units comprising first and second step surfaces and first and second handle bars for supporting a user, at least one of said units being displaceable by a body part of the user, and each unit having at least one associated first separate component, said first component being in effective communication with an assigned body part of the user, said first component of said first step surface comprising a first separate footplate associated with the first step surface, said first component of said second step surface comprising a second separate foot plate associated with the second step surface, said first component of said first handle bar comprising a first separate handle segment, and said first component of said second handle bar comprising a second separate handle segment;

(b) at least one damping element connecting a respective first component with a corresponding unit; and (c) at least one vibrating movement generator operatively connected to said first and second footplates and said first and second handle segments to selectively apply vibration movement to said first and second footplates and said first and second handle segments;

wherein said at least one damping element comprises a first damping element arranged between said first step surface and said first footplate, a second damping element arranged between said second step surface and said second footplate, a third damping element arranged between said first footplate and said first handle segment, and a fourth damping element arranged between said second footplate and said second handle segment.

2. The exercise device according to claim 1, wherein each unit has a vibration movement generator operatively connected to a respective first component of the unit for applying vibration movement to the respective first component of the unit independently of the first components of the other units.

3. The exercise device according to claim 1, wherein the vibration movement is produced electrically.

4. The exercise device according to claim 1, wherein the exercise device comprises a device that permits cross-training exercises.

5. The exercise device according to claim 1, wherein said at least one vibrating movement generator comprises first and second electric vibration motors associated respectively with said first and second footplates.

6. The exercise device according to claim 1, further comprising a connection element connecting said first and second handle segments, and said at least one vibrating movement generator comprises an electric vibration motor operatively connected to apply vibration movement to said handle segments through vibration of said connection element.

* * * * *